US006135505A

United States Patent [19]

Fendt et al.

[11] Patent Number: 6,135,505

[45] Date of Patent: Oct. 24, 2000

[54] METHOD OF LABELING HOUSINGS OF ELECTRONIC ASSEMBLIES AND PRODUCT PRODUCED THEREBY

[75] Inventors: Guenter Fendt, Schrobenhausen; Richard Baur, Pfaffenhofen, both of Germany

[73] Assignee: TEMIC Telefunken microelectronic GmbH, Heilbronn, Germany

[21] Appl. No.: 09/161,082

[22] Filed: Sep. 25, 1998

[30] Foreign Application Priority Data

Sep. 26, 1997 [DE] Germany ..... 197 42 456

[51] Int. Cl.[7] ..... B42D 15/00

[52] U.S. Cl. ..... 283/67; 283/70; 283/74; 283/81

[58] Field of Search ..... 283/67, 70, 74, 283/75, 79, 80, 81; 40/299, 633, 643, 642, 662

[56] References Cited

U.S. PATENT DOCUMENTS

| | | | |
|---|---|---|---|
| 1,516,547 | 11/1924 | Powell | 283/70 X |
| 1,992,779 | 2/1935 | Shedd | 283/70 |
| 3,643,358 | 2/1972 | Morderosia | 283/70 X |
| 4,326,907 | 4/1982 | Bornefeld et al. | 283/70 X |
| 4,515,867 | 5/1985 | Bleachen et al. | 283/70 X |
| 4,519,631 | 5/1985 | Stone et al. | 283/70 |
| 4,655,134 | 4/1987 | Chen . | |
| 5,298,731 | 3/1994 | Ett | 283/70 X |
| 5,463,838 | 11/1995 | Collier | 283/70 X |
| 5,725,253 | 3/1998 | Salive et al. | 283/70 X |

FOREIGN PATENT DOCUMENTS

| | | |
|---|---|---|
| 0653791 | 5/1995 | European Pat. Off. . |
| 4329083 | 3/1995 | Germany . |

*Primary Examiner*—Willmon Fridie, Jr.
*Attorney, Agent, or Firm*—W. F. Fasse; W. G. Fasse

[57] ABSTRACT

In a method of labeling housings of electronic assemblies, and especially electronic assemblies used in motor vehicle systems, at least some of the identifying indicia are applied directly as a deformation on or in the outer surface of a wall of the housing. The identifying indicia can be formed by laser etching of the housing surface, stamping of the housing surface, or forming the identifying indicia directly in the injection or casting mold used for molding the housing. The security and reliability of the labeling is improved because the identifying indicia cannot become detached from the housing as in the case when all of the identifying indicia are provided on a separate label plate or sticker. Additional identifying indicia, such as an optically scannable bar code, are printed on an adhesive label including a peel-off strip, and the adhesive label is affixed onto the outer surface of the housing.

20 Claims, 1 Drawing Sheet

METHOD OF LABELING HOUSINGS OF ELECTRONIC ASSEMBLIES AND PRODUCT PRODUCED THEREBY

PRIORITY CLAIM

This application is based on and claims the priority under 35 U.S.C. §119 of German Patent Application 197 42 456.2, filed on Sep. 26, 1997, the entire disclosure of which is incorporated herein by reference.

FIELD OF THE INVENTION

The invention relates to a method of labeling housings of electronic assemblies, and especially electronic assemblies for motor vehicle systems, with identifying indicia or designations such as a manufacturer brand name, a product type identifier, a manufacturing date, a manufacturing location, and a customer identifier. The invention further relates to an electronic assembly having a housing that has been labelled according to the method.

BACKGROUND INFORMATION

Electronic assemblies, and especially electronic assemblies used in motor vehicle systems, are typically received and enclosed in a respective housing for protecting the electronic circuits and other components against external influences. In order to identify the electronic assembly enclosed within the housing, the housing is typically labelled. Such labeling is especially important in the case of electronic assemblies used in motor vehicle safety systems, because all relevant data identifying the electronic assembly must be permanently, durably and visibly provided and available for later inspection.

For this purpose, the housing of the electronic assembly has conventionally been indirectly labelled by means of a label such as a label plate, placard or sticker affixed to the exterior of the housing. This separate label has been previously marked with relevant information such as a product type identifier, a series number, a batch number, a manufacturing date and location, a customer identifier, a bar code, and a color code. This information is typically printed on the label, which is then glued onto the housing of the electronic assembly. The label typically covers the majority of a respective exposed surface of the housing. For example in the case of an air bag control device, the label typically has dimensions of 7 cm×7 cm.

In some applications, the label may include several layers, or may include a so-called peel-off level, which comprises a previously labelled, removable peel-off strip that carries a portion of the product identifying information. Such a peel-off strip may, for example, be peeled off of the label that has been glued onto the housing, and then be pasted or otherwise adhered onto paperwork associated with the electronic assembly, for example the papers accompanying a motor vehicle in which the safety-related electronic assembly has been installed.

FIG. 1 shows such a housing of an electronic assembly that has been provided with a label or sticker affixed thereon in accordance with the prior art. The housing 1' includes mounting holes 2' and an electrical plug connector 3'. A label or sticker 4' is glued onto an outer surface of the housing 1', so as to cover a majority of that outer surface. The label or sticker 4' is typically a multi-layered adhesive film that has been printed with identifying indicia including alphanumeric indicia 6' and a bar code 7'. Furthermore, the label 4' includes an additional layer in the form of a strippable peel-off strip 5' that has also been printed with a bar code. This peel-off strip 5' can be peeled from the label 4' and adhered onto papers such as the papers accompanying a motor vehicle in which the electronic assembly has been installed.

It is disadvantageous that the conventional labels that are glued onto the housing are rather large and expensive. They require separate steps to be manufactured, printed, properly matched to the respective corresponding electronic assemblies that are to be labelled, and then glued onto the housings. Furthermore, potentially troublesome or even dangerous situations can arise because the labels can easily become removed from the housings, either before, during or after installation in the motor vehicle or the like. Such a loss of the labeling information can cause mistakes leading to the installation or replacement of the wrong electronic assembly for the particular application. Also, such loss of the labeling information can make it impossible to follow-up on a defect or malfunction in the electronic assembly, or make it impossible to identify the particular electronic assembly in the event of a product recall or the like.

SUMMARY OF THE INVENTION

In view of the above, it is an object of the invention to provide a method of labeling housings of electronic assemblies, and particularly electronic assemblies used in motor vehicle systems, whereby a separate label can be entirely omitted or at least the size thereof can be significantly reduced. Furthermore, it is an object of the invention to provide a method that avoids the complete loss of all identifying information regarding the electronic assembly, as can arise due to the unintentional detachment of a label that has been glued onto the housing. The invention further aims to provide a method and resulting product that avoid or overcome the other disadvantages of the prior art, and that achieve additional advantages, as apparent from the present description.

The above objects have been achieved according to the invention in a method of labeling the housing of an electronic assembly, and particularly an electronic assembly to be used in a motor vehicle system, with identifying indicia, wherein at least a portion of the identifying indicia are applied directly to an outer surface of a wall of the housing by means of deforming this outer surface. The above objects have further been achieved in a product, namely an electronic assembly arranged in a housing, that has been labelled with identifying indicia according to the method of the invention.

The main feature of the invention is that the identifying labeling of the housing is not carried out exclusively indirectly by means of a separate label plate, placard or sticker, as has been the case in the prior art, but instead at least a portion of the identifying labeling is provided directly on the housing by means of deforming an outer surface of the housing. For example, the identifying indicia may be applied to the housing directly by being burned into the outer surface of the housing by a laser labeling process, or by being pressed into the outer surface of the housing, or by being molded directly into the outer surface of the housing by means of an appropriate plastic injection molding process.

The invention achieves several advantages, including reducing or avoiding the costs of preparing, handling and adhesively applying a large-surface label. Furthermore, at least a portion of the labeling information is permanently provided and directly integrated into the outer surface of the housing, whereby the danger of accidental detachment and loss of the information is avoided.

The invention further provides advantageous detailed embodiments. For example, additional designations or indicia can be provided on a separate label that is affixed to the housing, in addition to the indicia that have been formed directly into the outer surface of the housing. As an example, a bar code or other indicia that are to be visibly apparent or optically machine scannable can be printed onto a label plate, placard or sticker, which is then adhesively affixed onto the housing. Moreover, this separate affixed label can be peelable or include a peel-off strip which may be peeled off and then adhered onto some other component or paper, such as the papers accompanying the vehicle in which the electronic assembly has been installed.

BRIEF DESCRIPTION OF THE DRAWINGS

In order that the invention may be clearly understood, it will now be described in connection with an example embodiment, with reference to the drawings, wherein.

DETAILED DESCRIPTION OF PREFERRED EXAMPLE EMBODIMENTS AND OF THE BEST MODE OF THE INVENTION

Figure 1:
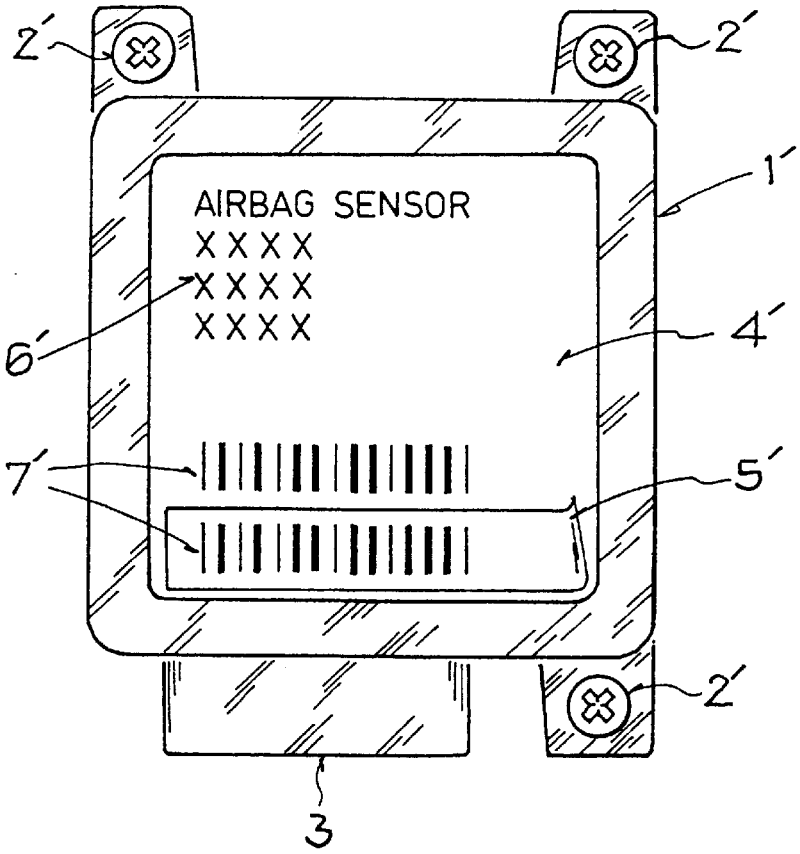
FIG. 1 PRIOR ART
FIG. 1 shows a prior art example of a separate label affixed to the housing of an electronic assembly.

FIG. 1 showing a conventional arrangement of a large separate label 4', bearing identifying indicia 6' and 7', on the housing 1' of an electronic assembly has been described above.

Figure 2:
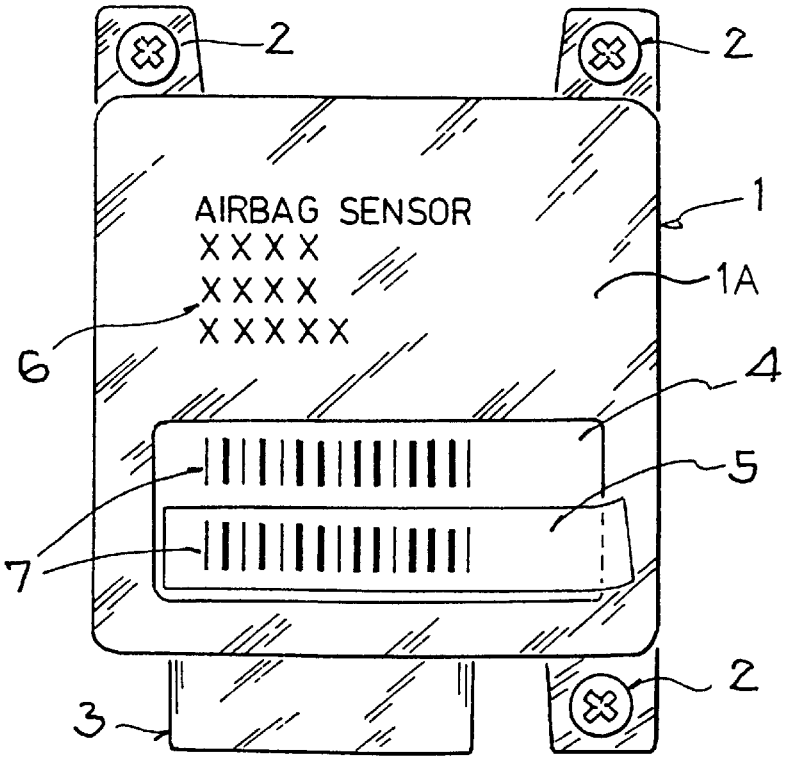
FIG. 2 shows the housing of an electronic assembly that has been provided with direct integrated labeling and a smaller separate label according to the invention.

FIG. 2 is a schematic plan view of the housing of an electronic assembly that has been provided with direct integrated labeling and a smaller label according to the invention. The housing 1 consists of plastic, such as a synthetic resin, or any other deformable material. The housing 1 encloses an electronic assembly adapted for use in a motor vehicle electronic system, such as an air bag sensor and/or an air bag control circuit, for example. The housing 1 has mounting holes 2 by which the housing and its enclosed electronic assembly can be mounted in the motor vehicle, and an electrical plug connector 3 by which the electronic assembly may be electrically connected to the vehicle system. Alpha-numeric text indicia 6 have been applied directly, e.g. printed or formed, onto or into the outer surface 1A of a flat wall of the housing 1.

Various processes can be used for printing or forming the identifying indicia onto or into the housing 1. For example, the text indicia 6 can be formed by laser etching. In such a process, a laser beam is used to heat the housing material in the proper pattern for forming the desired identifying indicia, whereby the heat deforms or otherwise alters the outer surface 1A of the wall of the housing 1. At the locations at which the housing material has been altered, for example by vaporizing away some of the material, the desired text indicia 6 are thereby formed. This manner of providing the labeling can be carried out before or after the electronic assembly has been installed in the housing.

Another possibility of carrying out the labeling is to use a corresponding stamp for directly imprinting the labeling onto or into the outer surface 1A of the housing 1. The stamp is appropriately embodied so that it mechanically or thermally deforms the outer surface 1A of the housing 1, and may further apply a colored ink or the like, at the desired locations for forming the identifying indicia. This process may also be carried out either before or after installing the electronic assembly within the housing, similarly as mentioned above.

Moreover, the housing 1 may already be appropriately labelled with the identifying indicia 6 at the time of manufacturing the housing 1. In order to label the housing 1 at the time of its manufacturing, the housing may be manufactured by means of injection molding or casting a synthetic plastic. In that case, the product type identifier, the manufacturer, the manufacturing location and other identifying indicia that remain the same for all electronic assemblies that will be installed in this particularly housing, can be integrated into the injection mold or the casting mold in which the housing will be molded.

All of the processes by which the housing 1 may be directly labelled with identifying indicia increase the process security and reliability in comparison to conventional methods in which a separate label plate, placard or sticker is glued onto the housing. This is achieved according to the invention, because there is no possibility of the most important or significant identifying information from becoming detached or separated from the housing which it identifies. Nonetheless, the invention further provides for a separate label 4 to be adhered onto the housing 1. In this example embodiment, the separate label 4 only includes the bar code 7 and a peel-off strip 5 with a duplicate of the bar code 7. With this arrangement, the peel-off strip 5 can be peeled off and adhered onto papers or the like that relate to the electronic assembly, such as the papers accompanying the vehicle in which the electronic assembly is installed.

It is advantageous to provide the bar code 7, which must be optically readable by a scanner, on a separate adhesive label 4, such as a sticker 4. Namely, it would be complicated and expensive to form the bar code 7 directly in the outer surface 1A of the housing 1 in the same manner as the alpha-numeric text indicia 6, with adequate properties such as clarity and optical contrast suitable to make the bar code optically readable by a scanner. Furthermore, it is desirable to provide the peel-off strip 5 in any event. This peel-off strip 5 allows for efficient and economical cataloging and tracking of the installed electronic assembly. Therefore, the present invention preferably includes a bar code applied onto a separate label, while all other identifying indicia 6 are applied directly onto the outer surface 1A of the housing 1 by means of one or more of the above named processes. As a result, during production of the electronic assembly and its housing, it is only still called for to provide a separate label of the minimal size necessary for accommodating the bar code and the peel-off strip.

According to the invention, such housings for electronic assemblies are not limited to application in motor vehicle electronic systems, but are also applicable in all other fields. In applications not requiring a peel-off strip, or a scannable bar code, the invention provides that all of the identifying indicia can be formed directly in or on the outer surface 1A of the housing 1, without any separate label at all.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method of labeling a housing for an electronic assembly, wherein said housing includes a housing wall bounded by a wall surface that has a general surface contour at least at a selected location, said method comprising the following steps:

a) forming identifying indicia including at least one of a manufacturer brand identifier, a product type identifier, a model number, a serial number, a batch number, a manufacturing date, a manufacturing location, a customer identifier, and a bar code, directly in or on said wall surface of said housing wall at said selected location by providing a deformation of said wall surface deviating from said general surface contour of said wall surface, wherein said deformation defines said identifying indicia; and b) affixing onto said wall surface a separate label bearing additional identifying indicia.

2. The method according to claim 1, wherein said electronic assembly is a motor vehicle electronics system component.

3. The method according to claim 1, wherein said deformation comprises indentations that are formed in said general surface contour of said wall surface and that define said identifying indicia.

4. The method according to claim 1, wherein said deformation comprises protrusions that are formed on and protruding from said general surface contour of said wall surface and that define said identifying indicia.

5. The method according to claim 1, wherein said additional identifying indicia comprise optically machine-scannable indicia.

6. The method according to claim 5, wherein said optically machine-scannable indicia comprise a bar code.

7. The method according to claim 6, wherein said identifying indicia formed directly in or on said wall surface do not include a bar code.

8. The method according to claim 5, wherein said additional identifying indicia consist of and are limited to a bar code.

9. The method according to claim 1, wherein at least a portion of said separate label bearing thereon at least a portion of said additional identifying indicia is adapted to be removed by peeling and to be applied onto another article, and further comprising a step of peeling off said portion of said separate label and then applying said portion of said separate label onto said another article.

10. The method according to claim 9, wherein said separate label is just large enough to accommodate said additional identifying indicia and said portion that is adapted to be removed.

11. The method according to claim 1, wherein said identifying indicia formed directly in or on said wall surface of said housing wall are sufficient to uniquely and unambiguously identify said electrical assembly that is received or to be received in said housing.

12. The method according to claim 1, wherein said step of providing said deformation of said wall surface comprises laser etching said wall surface.

13. The method according to claim 1, wherein said step of providing said deformation of said wall surface comprises pressing a forming stamp against said wall surface.

14. The method according to claim 1, further comprising a step of forming said housing by injection molding a housing material into a mold, and wherein said step of providing said deformation of said wall surface comprises providing a mold image of said identifying indicia in said mold and forming said deformation by means of said mold image during said injection molding.

15. The method according to claim 1, further comprising a step of arranging and enclosing said electronic assembly within said housing, and wherein said step of forming said identifying indicia is carried out before said step of arranging and enclosing said electronic assembly within said housing.

16. The method according to claim 1, further comprising a step of arranging and enclosing said electronic assembly within said housing, and wherein said step of forming said identifying indicia is carried out after said step of arranging and enclosing said electronic assembly within said housing.

17. An article of manufacture comprising:

a housing including a housing wall that is bounded by a wall surface, and that has identifying indicia including at least one of a manufacturer brand identifier, a product type identifier, a model number, a serial number, a batch number, a manufacturing date, a manufacturing location, a customer identifier, and a bar code, formed directly in or on said wall surface as a deformation of said wall surface, wherein said deformation defines said identifying indicia;

a separate label bearing additional identifying indicia printed thereon, affixed onto said wall surface; and an electronic assembly arranged in said housing.

18. The article according to claim 17, wherein said separate label comprises a base portion that remains affixed to said wall surface and a peel-off strip portion that is adapted to be separated from said base portion and adhesively re-affixed onto another surface.

19. The method according to claim 1, wherein said wall surface is an outer wall surface that faces an exterior of said housing.

20. The article according to claim 17, wherein said wall surface is an outer wall surface that faces an exterior of said housing.

* * * * *

UNITED STATES PATENT AND TRADEMARK OFFICE

CERTIFICATE OF CORRECTION

PATENT NO. : 6,135,505
DATED : October 24, 2000
INVENTOR(S) : Fendt et al.

It is certified that error appears in the above-identified patent and that said Letters Patent is hereby corrected as shown below:

Title page,
Item [56], References Cited, U.S. PATENT DOCUMENTS, insert -- 5,535,536 7/1996 Comann --;

FOREIGN PATENT DOCUMENTS, insert -- 4,136,619 5/1993 Germany 05-313585 11/1993 Japan --;

OTHER PUBLICATIONS, insert -- Elektrotechnik, Nr. 15, "Schalttafel-Klebeschild", No. 15, Mar. 27, 1964, pg.262; "Elektrizitaet in Fertigung und Organization" --.

Signed and Sealed this

Sixteenth Day of April, 2002

*Attest:*

*Attesting Officer*

JAMES E. ROGAN
*Director of the United States Patent and Trademark Office*